United States Patent [19]

Ehrsam

[11] Patent Number: 4,670,312

[45] Date of Patent: Jun. 2, 1987

[54] METHOD FOR PREPARING ALUMINUM FOR PLATING

[75] Inventor: Robert Ehrsam, Monroe, Conn.

[73] Assignee: John Raymond, Fairfield, Conn.

[21] Appl. No.: 699,856

[22] Filed: Feb. 7, 1985

[51] Int. Cl.[4] ..... B05D 1/18

[52] U.S. Cl. ..... 427/438; 204/38.4; 427/436

[58] Field of Search ..... 427/436, 438; 106/1.22, 106/1.23, 1.25, 1.26, 1.27, 1.29; 428/646, 647, 648, 650, 652, 653; 204/38.4

[56] References Cited

U.S. PATENT DOCUMENTS

| | | | |
|---|---|---|---|
| 1,372,290 | 3/1921 | Hurley | 106/1.23 |
| 3,672,964 | 6/1973 | Bellis | 204/38.4 |
| 3,932,685 | 1/1976 | Flowers | 427/436 X |
| 4,235,648 | 11/1980 | Richardson | 427/436 X |

*Primary Examiner*—Sam Silverberg
*Attorney, Agent, or Firm*—Felfe & Lynch

[57] ABSTRACT

Method for preparing aluminum, especially large aluminum pieces or articles having a surface layer of aluminum oxide for subsequent metal plating wherein the aluminum or aluminum alloy substrate is immersed in a bath containing metal salts and acid such that the acid content relative to the metal salt is sufficient to remove the surface aluminum oxide layer without substantial attack on the underlying aluminum while enabling the permanent deposit thereon of a continuous, smooth, adherent metal or metal alloy coating directly onto the aluminum, thereby replacing the aluminum oxide layer. Subsequent, essentially blister-free electroless or electrolytic plating of nickel or a nickel alloy, copper or a copper alloy onto the metal or metal alloy coated aluminum are made possible thereby.

17 Claims, 5 Drawing Figures

#3W4 (LEFT) SE1 50x 44 ZN (RIGHT)
SCANNING ELECTRON MICROGRAPH

#3W4 (LEFT) SEI 50x 44 ZN (RIGHT)
SCANNING ELECTRON MICROGRAPH

#3W4 SEI 100×

SCANNING ELECTRON MICROGRAPH

#44ZN SEI 100 x

SCANNING ELECTRON MICROGRAPH

#3W4 SEI 500x

SCANNING ELECTRON MICROGRAPH

#44ZN SEI 500x

SCANNING ELECTRON MICROGRAPH

METHOD FOR PREPARING ALUMINUM FOR PLATING

This invention relates to a method for preparing aluminum for plating which involves depositing an adherent metallic coating onto an aluminum surface while removing the aluminum oxide surface film.

BACKGROUND

Aluminum and its alloys are resistant to atmospheric and many other corrosive agents because of the presence of a thin film of aluminum oxide on its surface. If the metal is scratched exposing fresh metal, a thin, tenacious film is rapidly reformed by the reaction of the aluminum with oxygen in the air. Unfortunately the chemical reactiveness which causes aluminum to form this omnipresent oxide film and the resistance to corrosion which this film imparts to the base aluminum, also make aluminum and its alloys very difficult metals on which to apply other metal coatings by electroplating or electroless plating.

Since the large scale production of aluminum began early in this century there has been extensive research into methods for applying adherent coatings to aluminum. Several very successful processes have been developed and large quantities of aluminum alloy parts are electroplated every year for both decorative and functional purposes. The airline and aerospace industries as well as the military use a great deal of this material.

The most extensively used method is the zincate process which dates from the work of Hewitson (U.S. Pat. No. 1,627,900 issued in 1927) which, with improvements, is still the method used for the major portion of the aluminum which to be is plated. In this process, after suitable cleaning and acid dipping to insure a surface free from oils, gross contamination, and variations in the thickness of the oxide film, the aluminum is immersed in a concentrated alkaline solution of an alkali metal zincate (usually sodium zincate), the oxide film is dissolved and replaced with a continuous film of zinc metal deposited by chemical displacement. There are patented variants to the process, e.g., the addition of sodium cyanide or other complexing agents, the addition of other metal salts, etc. designed to make the deposit more adherent or simplify the processing. Basically, however, the process involves the removal of the oxide film and the deposition of the zinc film to prevent its reformation before the aluminum can be plated.

In the case of some electrodeposited metals, such as chromium, it is possible to go directly into the final plating bath, but usually it is necessary to go into a special copper strike bath to avoid interaction of the zinc with subsequent plating baths. This adds to the complexity of the process and increases the possibility of subsequent failure.

If the final metal plating is to be an electroless (autocatalytic) plate such as nickel deposited by chemical reduction using sodium hypophosphite instead of reduction by an externally applied electric current, the zinc acts as a poison to the electroless process making it difficult to initiate plating and is a strong contaminant to the bath causing it to plate at a greatly diminished rate.

Another less widely used process involves the deposition of an immersion tin coating from an alkali stannate bath followed by a bronze strike. A bath of this type is sold by M & T Chemicals of Rahway, N.J. under the name Alstan Process.

Other patented immersion processes are copper from acid solutions (U.S. Pat. No. 1,372,290 issued in 1921 to Hurley), tin from neutral or alkaline solutions (U.S. Pat. No. 1,045,718 issued in 1912 to Marino), iron from a ferrous chloride acid solution (U.S. Pat. No. 2,162,789 issued in 1939 to Raub et al.), antimony from acid chloride solutions (U.S. Pat. No. 2,485,182 issued in 1949 to Arent), brass from cyanide solutions (U.S. Pat. No. 2,496,845 issued in 1950 to Balden et al.), nickel from strongly acidic chloride solution (U.S. Pat. No. 2,746,136 issued in 1956 to Richaud), and heavy metals (e.g., cadmium, zinc, etc.) from fluoride, fluosilicate or fluoborate solutions (U.S. Pat. No. 2,297,241 issued in 1942 to Leonhard Perner).

Besides zincate or stannate baths, it is known to plate iron or aluminum from an acid solution (Grund '789) and nickel from an acid chloride solution (Richaud '136). Ironplating will rust if not processed promptly and has a tendency to produce very rough deposits. Nickel coating according to Richard '136 gives very rough granular deposits for later lead plating wherein the adhesion results from mechanical interlocking of the subsequent lead plate with the nickel. Accordingly, the Richaud process deliberately creates an uneven surface using basic solutions specifically for the purpose of facilitating mechanical adherence of the lead plate. The acid concentration is such that there must be continuous attack on the aluminum surface even after removal of the aluminum oxide. The immersion time in '136 may also serve as a basis for dissolution of the aluminum surface.

Also U.S. Pat. No. 4,360,411 issued in 1982 to Ladet, et al. is limited to aluminum electrical contacts and involves exposure of the aluminum to concentrated acid.

Immersion processes are preferred for preparing aluminum for subsequent plating since in general they require less time and equipment, are less critical to control and have the widest applicability of all the known methods. It has been found that prior immersion solutions do not give uniformly good adhesion on all aluminum alloys. Some are successful with relatively pure aluminum, some were with only casting alloys while others are only successful on wrought alloys.

SUMMARY

In the present invention aluminum or its alloys are prepared for either electroplating or preferably for electroless (autocatalytic plating). Hereinafter, a reference to aluminum refers to cast aluminum or to aluminum alloys whether cast or wrought. The method works with all casting alloys and most wrought alloys except for those which contain magnesium such as #7075 (aluminum alloy association designation as used herein).

These alloys are cleaned and then immersed in an acidic solution where the acid content is kept low with respect to the metal present. In theory, the acid solution dissolves the aluminum oxide present with minimal attack on the aluminum substrate, which in fact results in the deposit of a smooth adherent metal coating such as nickel or a nickel alloy on the surface. Either electroplated or electroless deposits may then be applied to the layer of immersion-plated metal coating on the surface of the aluminum substrate.

The principal advantages of this method over previous methods are simplicity, lower cost, absence of any deleterious reaction between the immersion alloy layer and most subsequent processing solutions, outstanding adhesion and smoothness of the subsequent plated metal coating to the aluminum substrate, and easier waste treatment due to freer rinsing because of the less viscous solutions involved and the absence of heavy metal salts.

Better results on aluminum are obtained if the deposited metallic coating is smooth and dull metallic in appearance with minimum roughness. Unlike the method claimed in the Richaud Patent '136, the acid content is kept low so as to minimize acid attack and subsequent surface roughness. It is essential to control the acid content relative to the metal salt so that only minimal dissolution of the aluminum occurs before there is a continuous coating of metal(s) such as nickel on the aluminum. The addition of one or two other metallic salts selected from metals more electronegative than aluminum can also give better results. Depending on the alloy used optimum results may be realized if copper and/or manganese are used as well to ensure a smooth, continuous coating of the Ni or Ni alloy. Also unlike Richaud, shorter immersion times are employed.

The simple nickel salt solutions properly formulated to avoid excessive reactivity give 90–95% adhesion in plating most wrought alloys as for example with electroless nickel and 100% adhesion in plating cast alloys as for example with electroless nickel.

The simple nickel salt solutions properly formulated to avoid excessive reactivity give 90–95% adhesion in plating most wrought alloys as for example with electroless nickel and 100% adhesion in plating cast alloys as for example with electroless nickel.

DESCRIPTION

Figure 1:
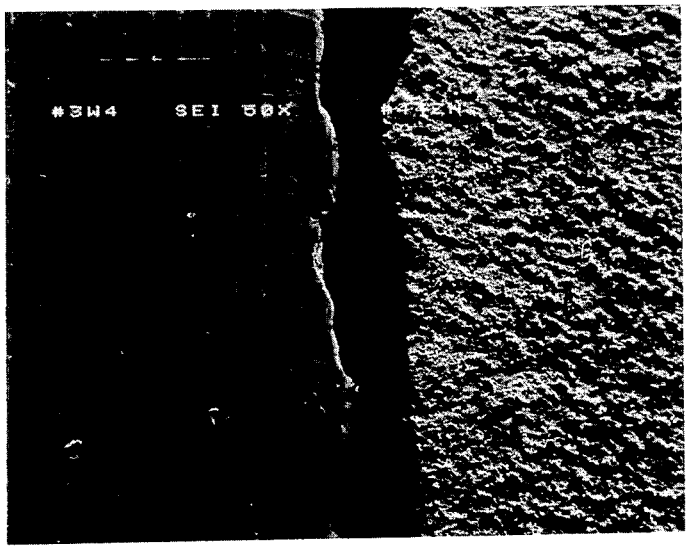
FIGS. 1–5 are scanning electron micrographs of aluminum plated according to the method of Example 7 as compared to aluminum plated according to the method of example 1 in the Richaud Patent.

Examples of single salt immersion solutions used in the preparation of aluminum for plating are found in examples 1, 2 and 3. However, all examples shown (1–7) are illustrative purposes only and are not meant to limit the invention. Indeed they are meant to illustrate the wide applicability of the method of the present invention. Many different metallic coatings on aluminum are made possible by the method of the invention.

Besides mechanical testing, such as chiselling and bending of plated panels, the adhesion of known plating solutions was evaluated by heating panels to 450° C. followed by a direct quench in cold water. This thermal cycle test, which puts great stress on the bond due to the comparatively large differences in the thermal coefficients of expansion between the plated metal and the base aluminum, was repeated three times and the test piece examined under low magnification of blisters. As used here, percentage adhesion refers to the percentage of test panels in a group that showed NO blisters, however small. For example, if there were no blisters in each panel of a group of ten adhesion is 100%. If 2 panels in a group of ten showed blisters adhesion is 80% etc.

In examples 1–7, the aluminum substrates were prepared for plating as follows:

1. Solvent degrease, if necessary
2. Alkaline clean 1 minute in the following solution:
   Sodium carbonate: 15 gms./liter
   Tetrasodium EDTA: 15 gms./liter
   Wetting Agent (Neutronyx 656 Onyx Chemical): 5 ml./liter
3. Water rinse
4. Acid dip 1:1 by volume Nitric acid (70% HN03)
5. Water rinse
6. Immersion plate
7. Water rinse
8. Electro or electroless plate Slight variations in the cleaning cycle do not affect the results, e.g., a nitric-hydrofluoric etch sometimes used in plating aluminum by the zincate process could also be used. We have also found that Boric acid as in example 5 can be eliminated and still give good adhesion after by the quench test. However Boric acid is used in the art especially under conditions such as those for serial production.

EXAMPLE 1

Nickel chloride hexahydrate: 690 gms./liter
Boric acid: 40 gms./liter
Hydrofluoric acid (70% v/v HF): 20 ml./liter
After cleaning the aluminum is immersed in the above solution at room temperature (a range of approximately 20°–30° C.) for 10–30 seconds, rinsed in water and plated in an electroless nickel bath. Cast aluminum pieces show 100% adhesion.

EXAMPLE 2

Cobaltous chloride hexahydrate: 690 gms./liter
Boric acid: 40 gms./liter
Hydrofluoric acid (70% v/v HF): 20 ml./liter
Cast aluminum processed in this solution as in Example 1 also gives 100% adhesion.

EXAMPLE 3

Ferrous sulfate septahydrate: 750 gms./liter
Boric acid: 40 gms./liter
Hydrofluoric acid (70% v/v HF): 20 ml./liter
Cast aluminum processed in this solution as in Example 1 also gave 100% adhesion.

Wrought alloys processed in any of the single salt solutions gave only 80–90% adhesion. Both two - and three component i.e. multi-component deposits deposited by the present immersion process gave better results on a wider variety of alloys. These examples are for illustrative purposes and are not meant to limit the invention to the salt combinations shown. Three typical binary alloys are shown in the following examples -

EXAMPLE 4

Nickel chloride hexahydrate: 100 gms./liter
Manganous chloride tetrahydrate: 10 gms./liter
Hydrochloric Acid (37% HCl): 20 ml./liter
Hydrofluoric Acid (70% HF): 20 ml./liter
Citric Acid: 50 gms./liter
Cast aluminum processed in this solution as in Example 1 also gave 100% adhesion; wrought alloys gave less than 100%. The coating deposited consisted of nickel 97.8% by wt. and mangnanese 2.2% by wt.

EXAMPLE 5

Nickelous fluoborate: 300 gms./liter
Manganous chloride tetrahydrate: 10 gms./liter
Boric acid: 50 gms./liter
Fluoboric acid (49% HBF): 125 ml./liter
Hydrochloric acid (37% HCl): 50 ml./liter Both cast and wrought alloys processed in this solution as in Example showed 100% adhesion.

EXAMPLE 6

Nickelous fluoborate: 150 gms./liter
Nickel hydroxyacetate: 135 gms./liter
Manganous chloride tetrahydrate: 10 gms./liter
Fluoboric acid (49% $HBF_4$): 125 ml./liter
Hydrochloric acid (37% HCl): 50 ml./liter Both wrought and cast alloys were processed in this solution as in Example 1 except that the immersion time was up to 90 seconds with 100% adhesion.

Three component deposit (ternary) alloys seemed to be brighter and more consistent results are achieved together with longer bath life. An example of a three-component deposit solution is given in the following example:

EXAMPLE 7

Nickelous fluoborate: 150 gms./liter
Nickel hydroxyacetate: 135 gms./liter
Manganous chloride tetrahydrate: 10 gms./liter
Cupric chloride dihydrate: 1 gm./liter
Fluoboric acid (49% $HBF_4$): 125 ml./liter
Hydrochloric acid (37% HCl): 50 ml./liter All aluminum alloys tested, including both wrought and cast alloys, gave 100% adhesion when processed as in Example 7 (90 sec) and subsequently plated with 0.0003" electroless nickel or with the same thickness of electroplated nickel. The composition of the alloy deposited was nickel 90.1% by wt., copper 9.0% by wt., and manganese 0.9% by wt. Example 7 is found to have a deposited alloy of composition 90% nickel by weight, 9% Mn by weight and 1% copper by weight as found by energy dispersive x-ray techniques.

Binary and Ternary coatings as in examples 4, 5, 6 and 7 may have wider applicability for aluminum substrates in the present invention than do the single metal coatings of examples 1, 2 and 3. Example 7 gives the best coatings and is best for electroless plating. The inclusion of Mn salt appears to be important for the smoothest deposit, the inclusion of Mn plus Cu in example 7 appears to be best of all. Mn seems to promote better adhesion of the Ni coating as well. In sum then, the bath of example 7 is better than that of example 5 which in turn is better than that of example 4 for smoothness of the Ni coating. Therefore, it is possible that different alloys (cast or wrought) may give better adhesion of Ni with Cu present, or with Mn present or with Mn and Cu present.

The presence of Mn for example enhances coatings and plating on 380 cast and 2000 series alloys. Cu +Mn together work on 1000, 3000 and 6000 series samples of aluminum alloys. THe 5000 series in probably positive since it contains Mn.

The results of the present invention can be seen in FIGS. 1–5 which are scanning electron micrographs.

FIG. 1 on the left sample 3W4, shows material prepared by the method of the present invention according to Example 7, while on the right of FIG. 1 is sample 44ZN, material prepared according to Example 1 of patent '136 of Richaud, both at 50X magnification. The marks on sample 3W4, the longitudinal striations, are the machining marks on the aluminum.

Figure 2:
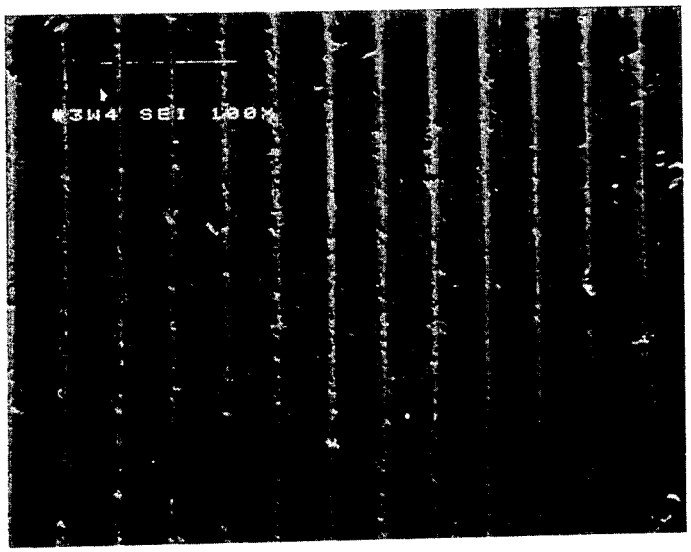
Figure 3:
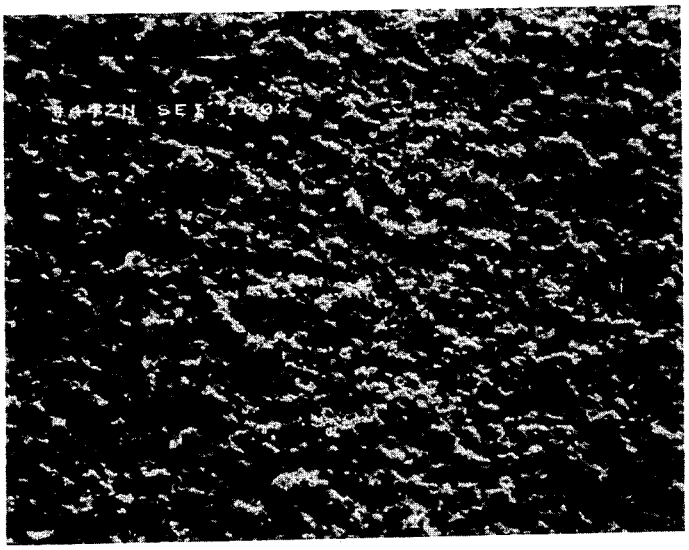
Figure 4:
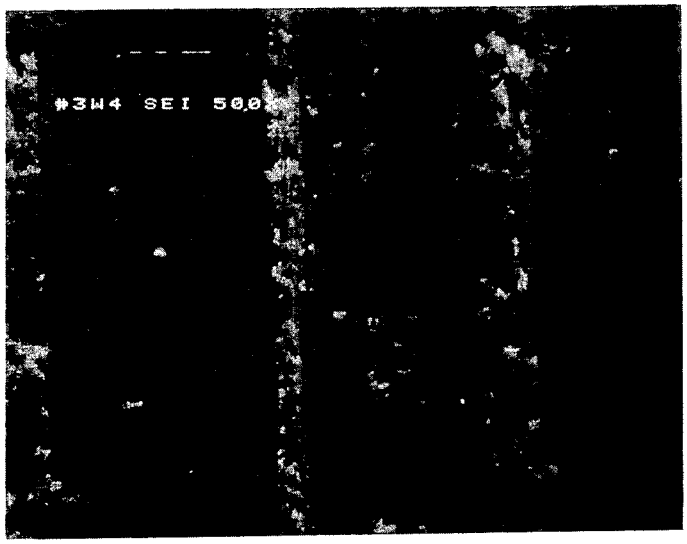
Figure 5:
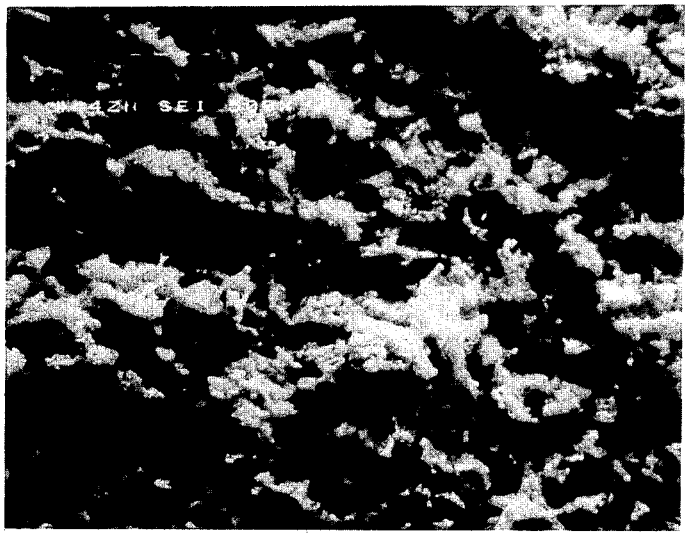

FIGS. 2 and 4 are the same sample 3W4 as in the left of FIG. 1 but at 100X and 500X magnification respectively, while FIGS. 3 and 5 are the same sample 44ZN, as in the right of FIG. 1 also at 100X and 500X magnification respectively.

These pictures show the continuous, smooth coating of the present invention as opposed to the highly uneven, discontinuous, crenulated surface of a previous coating method according to Richaud. Richaud uses caustic 100% NaoH in a pickling step at 73° C. for 3 min. to effect said surface. This step is absent from this invention. Richaud aluminum and/or passivates it. The present method uses a low concentration of acid with respect to the metal or metals as well as shorter exposure time of the aluminum substrate in the immersion bath. This results in a smooth adherent coating with a paucity of blisters. Better control of the acid content of the present method effects removal of the aluminum oxide without substantial, continuous acid attack on the aluminum substrate. Acid attack is also controlled by the shorter immersion time of the present invention. Boric acid appears to be necessary under serial production conditions. It is commonly used in the art.

Both Ladet ('411) and Richaud ('136) use $HNO_3$ acid treatment subsequent to the Ni immersion coating baths. Richaud styles this a neutralization [in 40° Bé $HNO_3$ (63% $HNO_3$ or 870 g/l)] and Ladet uses weaker acid which he asserts removes the thin Ni coating (5–20 g/l HF and 200–500 g/l $HNO_3$). It is well known that $HNO_3$ is aggressive with respect to Ni and a few seconds in $HNO_3$ should remove the thin Ni coating of Ladet or Richaud. The invention does not use such a step since it is an object of the invention to retain the Ni coating permanently for subsequent successful plating. The object of the Richaud method is to create an uneven aluminum surface with a granular nickel deposit whereas the present method strives for, and achieves, continuity and smoothness in the metal substrates and subsequent metal deposits.

A simple experiment shows this. The Richaud bath of Example I of the patent ('136) (400 gr $NiCl_2$, 40 g $H_3BO_3$, 200 cc HF and 1000 cc $H_2O$) is used for immersion of aluminum alloy (3003 or 360). The bath clearly dissolves away the aluminum within 15 minutes. Thus the bath obviously attacks the aluminum. Indeed as soon as a sample of cast or wrought aluminum is placed in the bath, a large amount of gassing occurs and large blisters from almost at once. The same experiment done with the bath of example 7 above of the invention shows no attack or dissolution of the aluminum alloy (3003 or 360). No surface asperities are seen even after sixty hours of immersion. (A continuous heavy, and non-adherent Ni deposit onto the aluminum is obtained after that time). Samples run at three minute immersions in the bath of Example 7 of the invention versus the bath of Example 2 of Richaud show that subsequent plating is unsuccessful on the Richaud sample as to adhesion - the plating peels off or is easily removed.

One of the important goals of this invention is to create a good surface for electroless nickel plating on aluminum whereas the object of the Richaud method is to plate lead electrolytically onto an uneven aluminum surface in which Ni is an incidental component. It is the uneven surface which is the goal of Richaud. It would appear there is mechanical interlock adhesion of the Ni deposit in Richaud because of the uneven aluminum surface resulting in a granular deposit. The bonding of the invention may therefore be chemical and or electrostatic in nature but there is probably minimal mechanical adhesion.

Electroless nickel plating baths were carried out in examples 1–7 with identical results. Among the baths tested was one from Allied-Kelite Div. of Witco Corp., Des Plaines, Ill., designated as their bath #794, and the following bath:

Nickel sulfate hexahydrate: 25 gms./liter
Sodium Hypophosphite monohydrate: 23 gms./liter
sodium acetate: 10 gms./liter
lead as lead chloride: 1 mg./liter
pH 4–6
Temperature 80–90 degrees celsius
15 minutes plating time deposits approximately 0.0003"

Electroless nickel combined with the bath of example #7 above gives the best results.

In the case of electrodeposits either a proprietary sulfamate nickel from Allied-Kelite Corporation was used, or the bath commonly described as a Watts bath and having the following composition:

Nickelous sulfate hexahydrate: 330 gms./liter
Nickelous chloride hexahydrate: 45 gms./liter
Boric Acid:
pH 2.7–3.5
Temperature 50–60 degrees celsius
Wetting agents, and brighteners can be added as desired.

Other metal salts can be used in the immersion baths. The following examples serve to illustrate the wide variety of substitutions possible. Cobalt and iron salts can be substituted for the nickel salts of the immersion baths with similar results although the iron salts gave a darker deposit and would rust. Cobalt works well but is more expensive. Also, Zinc, cadmium or tin salts can be substituted for the manganous salts of the immersion baths with somewhat poorer results. Furthermore, bismuth or silver can substitute for the copper salts of the immersion baths with slightly poorer results. Therefore it will be obvious to those skilled in the art that the method of the present invention encompasses a wide variety of metals and combinations of metals which can coat the aluminum or aluminum alloy surface prior to plating with a variety of metals. It is found that, for example, copper can be plated onto the aluminum after the immersion bath of example 7 using a Rochelle copper bath i.e. electrolytic plating.

What is claimed is:

1. Process for preparing an aluminum or aluminum alloy substrate, having a surface aluminum oxide layer for subsequent metal plating by a singlestep metal coating process which comprises.

immersing said aluminum substrate in a bath comprising nickel salt and manganese salt and an acid halide or mixture of acid halides wherein the acid content of the bath relative to the metal salt is sufficient to remove the aluminum oxide surface layer from the aluminum substrate, and said oxide is replaced with a permanent, smooth, adherent metal coating, without substantially attaching the underlying aluminum substrate and thereby enabling the subsequent electroless or electrolytic deposition.

2. Process of claim 1 wherein the acid halide of the immersion bath is selected from the group comprising, hydrochloric acid, fluoboric acid, hydrofluoric acid and mixtures thereof.

3. Process of claim 1 wherein of the immersion bath includes boric or citric acid.

4. Process of claim 1 wherein the immersion bath comprises

Nickel chloride hexahydrate: 100 gms./liter
Manganous chloride tetrahydrate: 10 gms./liter
Hydrochloric acid (37% HCl): 20 ml./liter
Hydrofluoric acid (70% HF): 20 ml./liter
Citric acid: 50 gms./liter

5. Process of claim 1 wherein the immersion bath comprises

Nickelous fluoborate: 300 gms./liter
Manganous chloride tetrahydrate: 20 gms./liter
Boric acid: 50 gms./liter
Fluoboric acid (49% $HBF_4$): 125 ml./liter
Hydrochloric acid (37% HCl): 50 ml./liter

6. Process of claim 1 wherein the immersion bath comprises

Nickelous fluoborate: 150 gms./liter
Nickel hydroxyacetate: 135 gms./liter
Manganous chloride tetrahydrate: 10 gms./liter
Fluoboric acid (49% $HBF_4$): 125 ml./liter
Hydrochloric acid (37% HCl): 50 ml./liter

7. Process of claim 1 wherein the immersion bath comprises

Nickelous fluoborate: 150 gms./liter
Nickel hydroxyacetate: 135 gms./liter
Manganous chloride tetrahydrate: 10 gms./liter
Cupric chloride dihydrate: 1 gm./liter
Fluoboric acid (49% HBF4): 125 ml./liter
Hydrochloric acid (37% HCl): 50 ml./liter

8. Process of claim 1 wherein the immersion bath includes a copper salt.

9. Product comprising the metal coated aluminum substrate obtained by the method of claim 1.

10. An immersion bath composition for preparing an aluminum substrate having a surface aluminum oxide layer for subsequent metal plating comprising a nickel and a maganese salt and an acid halide or mixture of acid halides wherein the acid content of the bath relative to the metal salt is sufficient to remove an aluminum oxide surface layer on the aluminum substrate, and said oxide is replaced with a permanent, smooth, adherent, essentially blister-free metallic coating directly onto the aluminum without substantially attacking the underlying aluminum.

11. Composition of claim 10 wherein the nickel salt is in the concentration range of approximately 1–750 gm/liter whereas the acid is in the concentration range of approximately 1–70 gm/liter.

12. Composition of claim 10 wherein the acid halide of the immersion bath is selected from the group comprising, hydrofluoric acid (70% HF), hydrochloric acid (37% HCl), fluoboric acid (49% $HBF_4$) and mixtures thereof.

13. Composition of claim 10 wherein the immersion bath comprises

Nickel chloride hexahydrate: 100 gms./liter
Manganous chloride tetrahydrate: 10 gms./liter
Hydrochloric acid (37% v/v HCl): 20 ml./liter
Hydrofluoric acid (70% v/v HF): 20 ml./liter
Citric acid: 50 gms./liter

14. Composition of claim 10 wherein the immersion bath comprises

Nickelous fluoborate: 300 gms./liter
Manganous chloride tetrahydrate: 20 gms./liter
Boric acid: 50 gms./liter
Fluoboric acid (49% $HBF_4$): 125 ml./liter
Hydrochloric acid (37% HCl): 50 ml./liter

15. Composition of claim 10 wherein the immersion bath comprises

Nickelous fluoborate: 150 gms./liter

Nickel hydroxyacetate: 135 gms./liter
Manganous chloride tetrahydrate: 10 gms./liter
Fluoboric acid (49% $HBF_4$): 125 ml./liter
Hydrochloric acid (37% v/v HCl): 50 ml./liter

16. Composition of claim 10 wherein the immersion bath comprises

Nickelous fluoborate: 150 gms./liter
Nickel hydroxyacetate: 135 gms./liter
Manganous chloride tetrahydrate: 10 gms./liter
Fluoboric acid (49% $HBF_4$): 125 ml./liter
Hydrochloric acid (37% v/v HCl): 50 ml./liter

17. Composition of claim 10 wherein the immersion bath includes a copper salt.

* * * * *

UNITED STATES PATENT AND TRADEMARK OFFICE

CERTIFICATE OF CORRECTION

PATENT NO. : 4,670,312

DATED : June 2, 1987

INVENTOR(S) : Robert Ehrsam

It is certified that error appears in the above-identified patent and that said Letters Patent is hereby corrected as shown below:

Column 4, line 67: after "49%" delete "HBF" and insert -- $HBF_4$ --.

Column 6, line 9 : after "Richaud", insert -- also uses strong $HNO_3$ to neutralize which acid attacks --.

Column 7, line 21: after "Boric Acid:" insert -- 35 gms/liter --.

Column 7, line 57: Claim 1, line 57, after "substantially" delete "attaching" and insert -- attacking --.

Signed and Sealed this

Twenty-sixth Day of July, 1988

*Attest:*

DONALD J. QUIGG

*Attesting Officer*

*Commissioner of Patents and Trademarks*